US009797583B2

(12) United States Patent
Hanslip

(10) Patent No.: US 9,797,583 B2
(45) Date of Patent: Oct. 24, 2017

(54) LED LIGHTING WITH FRANGIBLE CIRCUIT BOARD AND HEAT SINK MOUNT

(71) Applicant: Ryan P. Hanslip, San Francisco, CA (US)

(72) Inventor: Ryan P. Hanslip, San Francisco, CA (US)

( * ) Notice: Subject to any disclaimer, the term of this patent is extended or adjusted under 35 U.S.C. 154(b) by 287 days.

(21) Appl. No.: 14/548,270

(22) Filed: Nov. 19, 2014

(65) Prior Publication Data

US 2015/0138772 A1 May 21, 2015

Related U.S. Application Data

(60) Provisional application No. 61/906,111, filed on Nov. 19, 2013, provisional application No. 62/027,164, filed on Jul. 21, 2014.

(51) Int. Cl.

| | |
|---|---|
| ***F21V 21/005*** | (2006.01) |
| ***F21V 23/06*** | (2006.01) |
| ***F21V 15/01*** | (2006.01) |
| ***F21S 4/28*** | (2016.01) |
| *F21Y 103/10* | (2016.01) |
| *F21Y 115/10* | (2016.01) |

(52) U.S. Cl.

CPC ..... *F21V 21/005* (2013.01); *F21S 4/28* (2016.01); *F21V 15/013* (2013.01); *F21V 23/06* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

2012/0291269 A1* 11/2012 Fiene ..... F21V 29/20 29/825
2013/0207879 A1* 8/2013 Rada ..... H01Q 1/38 343/893
2014/0292176 A1* 10/2014 Athalye ..... F21V 29/70 313/46

* cited by examiner

*Primary Examiner* — Sharon Payne

(74) *Attorney, Agent, or Firm* — Vangelis Economou; Economou IP Law

(57) ABSTRACT

An LED strip lighting fixture having an array of LEDs mounted on a frangible rigid aluminum base having a predetermined thickness, the thickness including predetermined points of weakness, whereby the rigid, preferably aluminum, base can be broken at the predetermined points of weakness. The rigid base has disposed thereon a laminated integrated circuit on which are mounted a plurality of electrical elements including a plurality of light emitting diodes in series electrical connection on the laminated integrated circuit whereby the frangible sections of the rigid base provide for easy customization in providing predetermined length dimensions of the rigid aluminum base and LED mounted lighting fixture. A secondary benefit of the interconnectability of the integral base and LED combination is that the heat of expansion and subsequent contraction of the metal base is accommodated by the mount and housing to reduce tick and ping noise.

7 Claims, 2 Drawing Sheets

LED LIGHTING WITH FRANGIBLE CIRCUIT BOARD AND HEAT SINK MOUNT

CROSS REFERENCE TO RELATED APPLICATIONS

This is a non-provisional of Provisional application Ser. No. 61/906,111, filed Nov. 19, 2013, now pending, and of Provisional application Ser. No. 62/027,164, filed Jul. 21, 2014, now pending, the entire specifications of which is incorporated by reference herein as if fully set forth.

BACKGROUND OF THE INVENTION

1. Field of the Invention

This invention relates generally to light emitting diodes (LEDs) and more specifically to LEDs mounted on rigid circuit boards with an integrated aluminum heat sink where the circuit boards are frangible and also include the heat sink as an integrated element.

2. Background Art

Light emitting diode (LED) lamps are replacing incandescent lamps because of lower energy consumption, increased efficiency and longer lifetimes of the lamps. Low-intensity LEDs can provide efficient luminosity without requiring excessively large heat sinks. For low power LEDs, heat can be dissipated through multi-layered printed circuit board. The heat dissipation therethrough is normally sufficient to keep the LED junction temperature under the maximum rated value set by the manufacturer. However, increasing power and LED intensity requires an external sink for dissipating heat which cannot be adequately channeled through the printed circuit board and lamp base.

With mounting of LEDs in large arrays to provide increasing luminosity, use of numerous densely packed LEDs becomes increasingly difficult because of the need to provide large heat sinks to remove heat, without detracting from the appearance of the lamps and avoiding possibly blocking some of the emitted light. The self contained nature of LEDs, which are usually powered through electronic circuits having an outside power source, require that the heat sink efficiently remove heat from the circuits and from the LED itself. Especially when higher intensity LED lamps are used, the heat dissipation requirements increase and heat sinking properties of various thermally conductive materials have been relied on in providing the heat sink capacity for concentrated arrays of LEDs.

Thermal management of high power LEDs is generating intense scrutiny in the field. Since common FR4 circuit boards do not provide a high level of heat dissipation, it has been found that aluminum is a good heat sink material. For example, described in U.S. Pat. No. 7,1921,55, an aluminum base plate is used for mounting LEDs. This type of heat sink removes heat from the integrated circuits associated with the LEDs and acts to transfer the heat from the base to an outer housing which acts as the external heat sink for removing heat.

It has also been found desirable in the manufacture of LED arrays to provide circuitry that is capable of being subdivided by manual methods without affecting the ability to connect the underlying circuitry to a source of power and to control mechanisms. In U.S. Published Patent Application No. 2013/0083533 to Janik et al., proposes to use a base for an array of LEDs that is frangible so that it can be folded into a space for use in a lamp that resembles in form a normal incandescent bulb. Janik et al. propose for dissipating heat in higher intensity LED lamps, individual LEDs mounted on a thermally conductive medium, such as an aluminum plate. However, mounting LEDs on a plate of even nominal thickness will reduce the view angle of the emitted light, resulting in a noticeable band of lower intensity light when projected on a nearby surface. Thus, the need for a frangible board that permits the folding into a configuration that fits into the space available.

Another method use of an array of LEDs is in a line array along a strip or elongated fixture which has a variable length. Architectural lighting applications call for long, seamless linear lighting fixtures that may be visible in plain sight. Some products available in the form of FR4 fiberglass/epoxy rigid circuit boards can be manufactured in varying lengths and can be assembled with soldered pins in an additive fashion to make the arrays in desirable lengths. This type of rigid light engine assembly is sometimes prone to connection failures between the sections due to shock or vibration in transit during installation and through rugged use. An increase in labor time and costs for assembly results in many instances because the junctions must be soldered by hand. The many solder junctions and mechanical electrical connections can also create a weak point in the circuit. Metal linear fixtures may expand and contract as the light array warms up and cools down, fatiguing solder joints over time and causing premature failures as well as other problems with noise and ingress protection.

A linear array should ideally be suitable for direct view applications (diffused light versus pixelation or 'dots'), and should also be able to be cut to desired lengths to fit millwork, coves, shelving, etc. so as to mitigate the appearance of dead spots without light. Thin, flexible circuit boards are currently employed for these applications. So called "tape lights," in which strips of somewhat flexible tape on which LEDs are mounted, serve this function, but several drawbacks exist with such use. Among these are the inability to adequately remove heat from mid-power LEDs because these flexible materials, although allowing to be cut to a desired size by, for example scissors, the heat sink capabilities of such flexible tape materials remain wanting. The requirement for a fit to size linear array heretofore has not been addressed in the context of high intensity LED arrays that generate a significant amount of heat so as to impair the operation of the devices with continuous use. What is needed is a variable length, frangible linear LED heat sink with circuit board manufacturing techniques that is made from aluminum or other rigid heat sink material.

SUMMARY OF THE INVENTION

Accordingly, there is provided herein a strip lighting fixture having an array of Light Emitting Diodes comprising a frangible rigid aluminum base extending in a longitudinal direction from a first end to a second end, the base having a predetermined thickness, the thickness including predetermined points of weakness, whereby the rigid aluminum base can be broken at the predetermined points of weakness, a laminated integrated circuit disposed on a surface of the rigid aluminum base, a plurality of electrical connections disposed at positions adjacent each of the predetermined points of weakness and the first and second ends of the rigid aluminum base, and a plurality of light emitting diodes in series electrical connections to the laminated integrated circuit whereby the frangible sections of the rigid aluminum base provide for a easy customization in providing predetermined length dimensions of the rigid aluminum base and LED mounted lighting fixture.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

Figure 1:
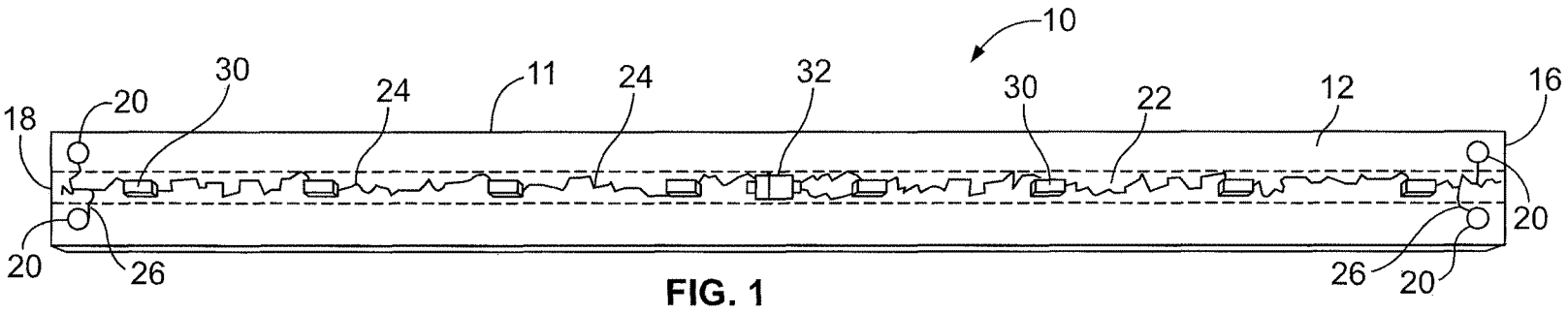
FIG. 1 illustrates a plan view of a basic section of a linear LED array according to the present invention.

Referring now to FIGS. 1 and 24, a basic section 10 of an LED array according to the present invention is illustrated. The basic section 10 includes a longitudinally extending base or substrate 12 having a predetermined length, for example, four inches, but as small as one inch long is possible. Beveled edges 14 are disposed adjacent a bottom surface 13 at either end 16, 18, the bevels extending in the transverse direction to the longitudinal length of the substrate 12. Preferably, the substrate 12 comprises a metal having good heat conductive properties, but for cost and efficiency reasons, aluminum is preferred. The nominal thickness of the substrate as measured from the surface 11 to the surface 13 is about ¾ inch, although this may be modified depending on the configuration desired. Also adjacent each end 16, 18 are two posts 20 for electrical connections to the external power source (not shown).

Laminated onto the top surface 11 of the substrate 12 is an integrated circuit strip 22 shown in broken lines. Strip 22 extends between each end 16, 18 of the substrate 12 and as will be described below, can be a single layer of laminate material with metallic or metalized leads 24 extending therethrough and providing an electrical circuit between the elements of the device basic section 10. Conveniently, each of the posts 20 are provided with an electrical connection 26 to the strip 22 so as to provide power and control to the circuitry 24 of the strip 22 and to the other elements of the device basic section 10. The power and control is provided from an external network and power supply, such as an electrical grid (not shown) being connected to the posts 20 at installation.

Attached to appropriate locations on the strip 22 are several electrical elements, such as diodes, resistors, etc. (not specifically shown). Light emitting diodes 30 are shown to be in an array evenly spaced for each other and connected to the electrically conductive laminated strip 22 by soldering or other appropriate means. When LEDs 30 are soldered onto the laminated strip 22, the LEDs 30 are electrically connected to the circuitry 24 and comprise part of the circuit of each of the basic portions 10. The LEDs 30 can be standard commercially available LEDs, such as Citizen CLL 625 type LEDs, preferably each able to carry a load of 3 volts, at 0.25 watts and providing 25 Lumens. Other types of these LEDs 30, having different characteristics and specifications, can be used if necessary to provide for different applications, as needed, and a person having sufficient skill in the art can easily replace and substitute appropriate ones of the LEDs as needed for a specific application.

It is important to note that each of he LEDs are directly mounted onto the surface of 11 of the rigid aluminum base 12 and provide a mounting surface that is in direct interfacing relationship with the surface 11. This interface provides for direct heat conduction from each of diodes 30 to the surface of the aluminum base 12 such as to provide a sufficient amount of heat sink capability to the diode and to maintain the temperature thereof in an operational range that retains the long term life of the diode. The thickness of the aluminum base 12 has sufficient dimensions to wick off the excessive heat generated by the most intense of commercially used mid and high power LEDs used in lighting of this type. Additional customization is possible to provide for thicker or thinner aluminum bases 12 depending on the desired characteristics of the application in which it is desired to install the device.

Also in line and taking a central position of each device basic section 10 is an Integrated Circuit (IC) current regulator 32 for providing a continuous steady current throughout the IC strip 22. The current regulator 32 is important to maintain a steady light intensity, and also to provide the capability of configuring the system to enable it to vary the light intensity as desired by the user. The IC current regulator 32 is also commercially available and comprises, for example, a Calentech NSI45020AT1G type IC current regulator.

Figure 3:
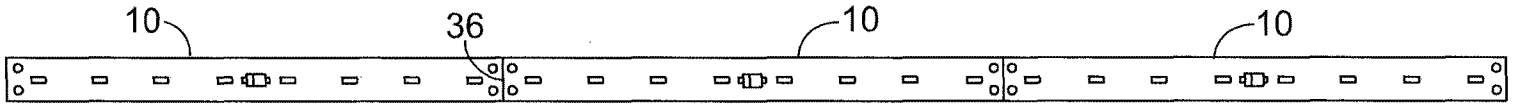
FIG. 3 illustrates a plan view of plural basic sections of linear LED arrays according to the present invention in a joined, unbroken state.
Figure 4:
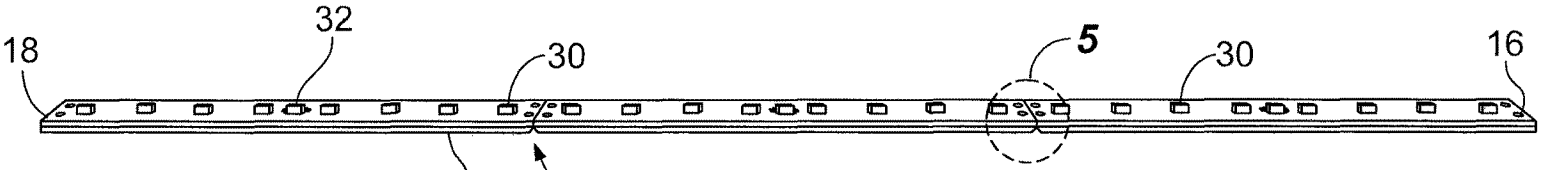
FIG. 4 illustrates a side view of the plural basic sections of linear LED arrays of FIG. 3 where the plural sections are in a joined, unbroken state.
Figure 5:
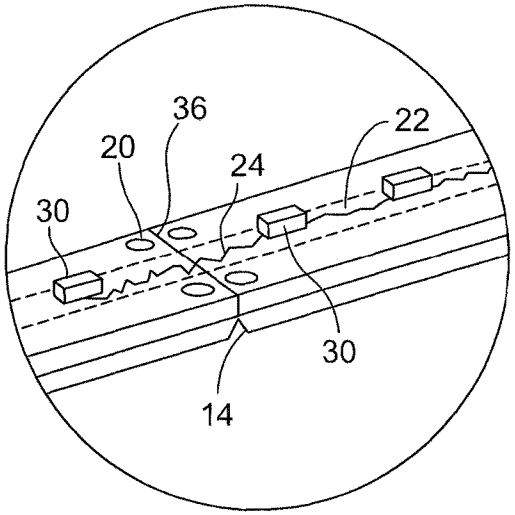
FIG. 5 illustrates in a detail perspective view of the plural section LED array of FIG. 4 showing a score line between two adjacent sections for enabling the frangible break point according the present invention.

Referring now to FIGS. 3, 4 and 5, several of the basic sections 10 are shown attached to each other as they would be when manufactured. As these are integral when originally manufactured, the top portions of the substrates 12 are connected to each other at their ends, that is, one end 16 is connected to the end 18 of an adjoining basic section 10. When the laminated strip 22 is applied to the top surface 11 of the basic sections 10, it is applied as a single strip 22 for the length of the connected plural sections 10 all along its longitudinal extension, without a break in the circuitry 24. The strip 22 is also provided at each of the posts 20 with a separate electrical connection 26 to the circuitry 24, or can be electrically connected thereto by appropriate connection such as soldering or spot welding.

At a bottom surface of the adjoining basic section 10, the beveled edges 14 provide score lines 36 at each of the ends 16, 18 so that the dimension between the apex of the score line 14 and the top surface 11 is much smaller than the thickness dimension between the surfaces 11, 13. Thus, it is easy to break away one basic section 10 from the remaining sections 10, making each of the sections frangible and capable of providing plural sections 10 having a desired length for any particular application. The scoring 36 allows for the luminaire to be broken by hand, to fit within custom length fixture housings. Custom length fixture housings can be cut to predetermined dimensions at the assembly plant.

While FIGS. 3 and 4 show a device having three plural sections 10 adjoining each other, having a nominal length of 12 inches, any length of the device can be specified up to 96 inches, the maximum length allowed for shipment by most common carriers. Even longer devices can be customized and to be sent by special courier so long as the length of the device can be transported to the installation location without damage.

Figure 2:
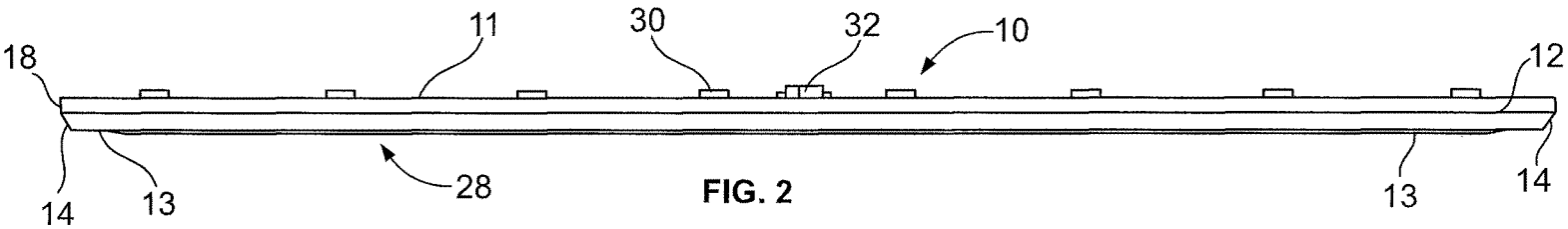
FIG. 2 illustrates a side view of the basic section of a linear LED array of FIG. 1.

Referring now to FIG. 5, it is seen in the detailed view that the score line 36 provides for a much weaker point of contact and provides a point where the device components can easily be separated in the lateral or transverse direction. The user can break the integral plural section device at a score line 36, thereby rendering a plural basic section device 28, as shown in FIGS. 3 and 4 into a smaller, but equally operational basic section 10, having a desired length, such as a basic section 10 of four inches as shown in FIGS. 1 and 2. Because each section has an external electrical connection to the external power source at each of the posts 20, the user need only break away the sections 10 that are to be used in an application and then connect the sections at either end to the power supply at the posts 20.

Figure 6:
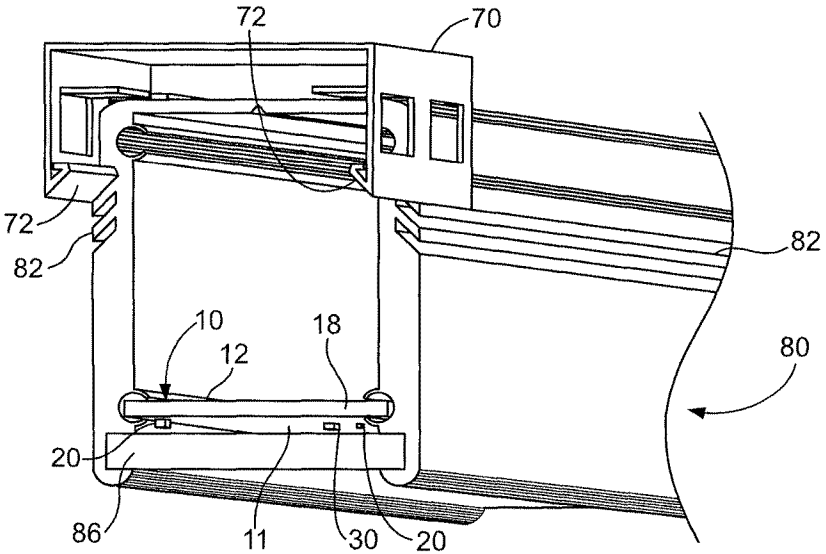
FIG. 6 is a detail perspective view of the fixture housing for use with the inventive LED array configuration.

Attaching the substrate 11 having eh desired length to a housing 80, and ultimate installation of the housing in the desired location to provide for the lighting is now described in greater detail with reference to FIG. 6. A mount 70 having mounting clips 72 at opposed ends can engage appropriately shaped and oriented slots 82 in the housing 80 so that the mounting 70 retains the housing in sturdy and rugged attachment to the appropriate architectural feature. A lens 86, either clear or partially translucent, or both, can provide a cover for the housing. Insertion of the strip of the aluminum base 10 in which the diodes 30 are mounted within housing 80, with the surface 11 being downwardly facing (in FIG. 6) so that the light from the LEDs is directed through the lens 86 and into the area in which lighting is desired, completes the installation. The ends of the housing 80 are open and thus provide easy access for electrical connections to the posts 20 disposed at the appropriate longitudinal ends of the plural sections closes to the open ends of the housing 80.

The end-to-end connectability of the mounting clips 72 provides for independent suspension of each basic section 10 or plurality of basic sections 10 and provides an added benefit. The basic sections 10 are integral and mounted essentially as one element within the housing 80, and thus expansion of the rigid base 12 of each plurality of base sections 10 due to heating thereof by the continued emission of light and heat absorption thereof is accommodated by the configuration illustrated and disclosed herein. That is, as the expansion often leads to snap and crackles when adjoining pieces of expanding metal impinge on each other or on the housing elements, the configuration of the mount 70 and housing 80 result in mitigation of the noise that is created when the metal either expands with heating or contracts when the device is turned off and the metal cools.

Several features of the invention are illustrated and described above that provide distinct advantages and significant improvements to the lighting of commercial or residential spaces. First is the ability for an assembler to size the internal luminaire to the appropriate length to fit within custom architectural lighting applications. Another significant feature is to provide of an adequate heat sink to dissipate the heat generated by the recently developed and commercially available mid and high power diodes while simultaneously minimizing dead spots on the ends of the luminarie by maintaining the diodes all the way to the ends 16, 18. Also important to the installer is the ability to provide a customized installation of a luminaire having a specified length to fit within a particular application, without requiring extensive rework on the job site. For example, if a luminarie of about 20 inches is required for a space, a housing 80 of that length is installed by inserting into the mounting clip 70 as described above, and a LED array of twenty inches is snapped off of a longer plural section device, i.e., a length having perhaps 5 of the basic sections 10. This plural section is then inserted into the housing 80 which by sliding lengthwise into the appropriate slot in the housing 80, and connecting the posts 20 only at the ends of the plural section device to the power source and switch that can be used to control the intensity or on/off status of the light fixture.

The invention herein has been described and illustrated with reference to the embodiments of FIGS. 1-6, but it should be understood that the features and operation of the invention as described is susceptible to modification or alteration without departing significantly from the spirit of the invention as disclosed above. For example, the dimensions, size and shape of the various elements may be altered to fit specific applications, for example, other shapes than the bevels 14 can be used to provide the score lines 36, such as transversely extending slots. Other modifications are possible, as described in the above specification. Accordingly, the specific embodiments illustrated and described herein are for illustrative purposes only and the invention is not limited except by the following claims.

What is claimed is:

1. A strip lighting fixture having an array of Light Emitting Diodes comprising:

a) a frangible rigid metal base extending in a longitudinal direction from a first end to a second end, the base having a predetermined thickness, the thickness including predetermined points of weakness, whereby the rigid metal base can be broken at the predetermined points of weakness into at least two sections so as to separate the sections one from the other, wherein separation of the sections from the rigid metal base provides for each section having an external electrical connection to an external power source so as to not affect the operation of the array of Light Emitting Diodes of each section;

b) a laminated integrated circuit disposed on a surface of the rigid metal base;

c) a plurality of electrical connections disposed at positions adjacent each of the predetermined points of weakness and the first and second ends of the rigid metal base; and d) a plurality of light emitting diodes in series electrical connections disposed onto the laminated integrated circuit;

whereby the frangible sections of the rigid metal base provide for an easy customization in providing predetermined length dimensions of the rigid metal base and LED mounted lighting fixture by separation of the sections to the desired length of the rigid metal base, wherein separation by breaking of two adjacent sections of the frangible rigid metal base at the predetermined points of weakness continues to maintain the series electrical connections between the Light Emitting Diodes in each section.

2. The strip lighting according to claim 1 wherein the rigid metal base comprises aluminum.

3. The strip lighting according to claim 1 wherein the plural sections of the array extend to approximately 96 inches.

4. The strip lighting according to claim 1 wherein the plural sections of the array extend to approximately 24 inches.

5. The strip lighting according to claim 1 wherein the plural sections of the array extend to approximately 12 inches.

6. The strip lighting according to claim 1 wherein each section of the frangible rigid aluminum base includes a beveled edge to each section to permit breaking at score lines defined by the beveled edges.

7. The strip lighting according to claim 1 wherein each section of the frangible rigid aluminum base electrical connections further comprise posts for connection of each section to the external power source.

* * * * *